United States Patent [19]

Bacon et al.

[11] Patent Number: 4,644,653

[45] Date of Patent: Feb. 24, 1987

[54] RECIPROCATING KNIFE

[76] Inventors: Donald V. Bacon, 6017 Gateway Green, Monona, Wis. 53716; David D. Bacon, 1070 County Trunk N, Stoughton, Wis. 53589

[21] Appl. No.: 760,488

[22] Filed: Jul. 30, 1985

[51] Int. Cl.[4] ..... B26B 7/00

[52] U.S. Cl. ..... 30/272 R; 30/272 A; 74/50

[58] Field of Search ..... 30/272 A, 272 R, 393, 30/394, 392; 74/50

[56] References Cited

U.S. PATENT DOCUMENTS

| | | | |
|---|---|---|---|
| 3,283,407 | 11/1966 | Bacon | 30/272 A |
| 3,315,356 | 4/1967 | Swanke et al. | 30/272 A |
| 3,316,636 | 5/1967 | Raper, Jr. et al. | 30/272 A X |
| 3,337,952 | 8/1967 | Rosen | 30/272 A |
| 3,359,637 | 12/1967 | Hansen | 30/272 A |
| 3,359,809 | 12/1967 | Spender | 74/55 |
| 3,367,026 | 2/1968 | Levine | 30/272 A |
| 3,461,556 | 8/1969 | Chambers | 30/272 A |
| 3,585,719 | 6/1971 | Kivela | 74/50 X |
| 3,650,029 | 3/1972 | Trelc | 30/272 A |
| 3,664,021 | 5/1972 | Sawyer | 30/272 A |
| 3,832,776 | 9/1974 | Sawyer | 30/272 A |

*Primary Examiner*—Frank T. Yost

*Attorney, Agent, or Firm*—Isaksen, Lathrop, Esch, Hart & Clark

[57] ABSTRACT

An improved reciprocating knife includes a blade with a blade opening, a blade guide defining a track for guiding the blade reciprocation, a blade drive having a rotating drive shaft and an angled cam plate which extends into the blade opening, means for mounting the blade drive such that rotation of the drive shaft causes the cam plate to engage the rim of the blade opening to reciprocate the blade, and biasing means for biasing the rim of the blade opening against the cam plate to modulate the play between the cam plate and the rim. The biasing means is designed to aid blade reciprocation over a portion of the reciprocating cycle and to resist blade reciprocation over another portion of the reciprocating cycle. Reinforcing for the rim of the blade opening, a replaceable blade cutting edge section, and a collar for adjusting the fit of the drive shaft in the knife are also disclosed.

17 Claims, 6 Drawing Figures

Fig 1
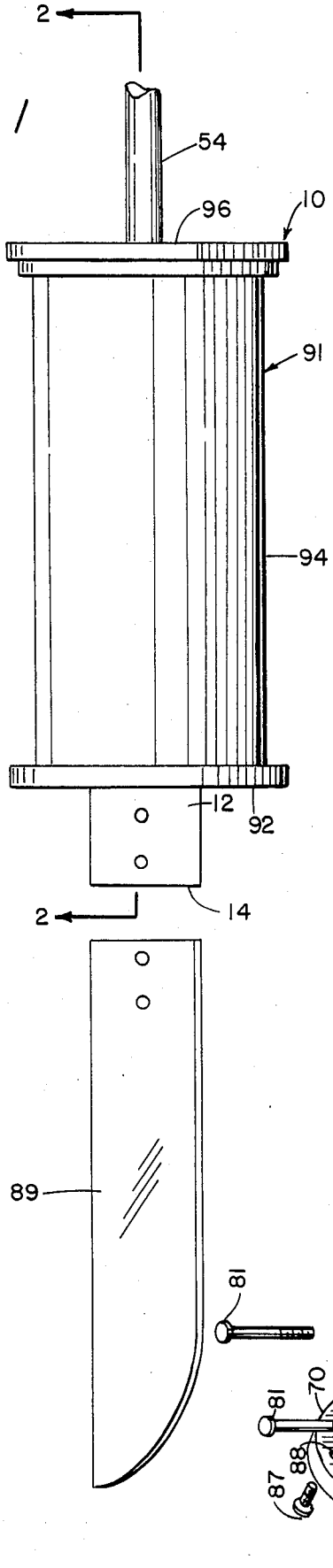
Fig 2
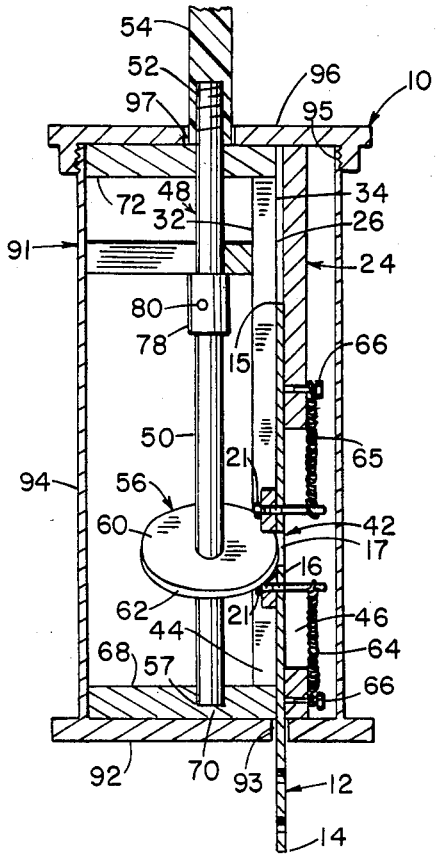
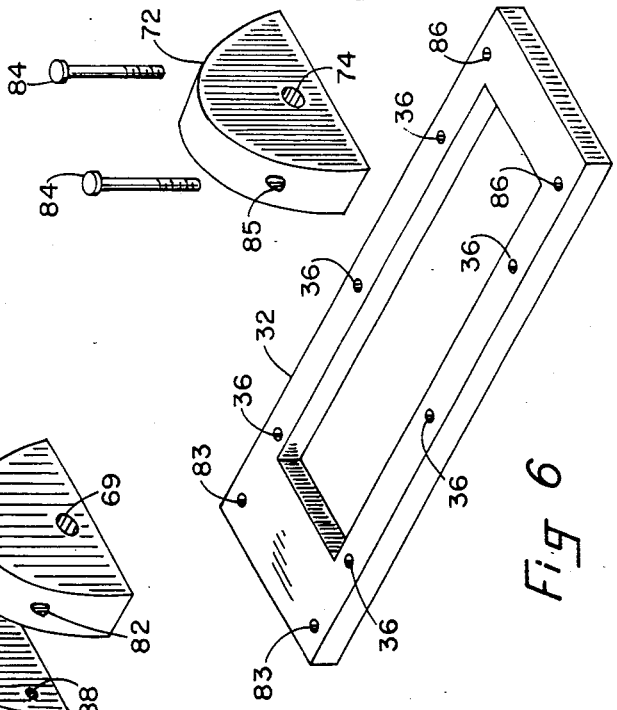
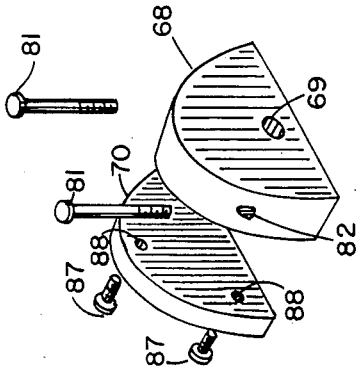
Fig 6

RECIPROCATING KNIFE

TECHNICAL FIELD

This invention relates to reciprocating knives and particularly to reciprocating knives wherein the blade is mechanically driven forwardly and rearwardly by a rotating drive shaft.

BACKGROUND OF THE INVENTION

Reciprocating knives have been widely accepted in industry and in the home as labor-saving devices which enable the user to easily and accurately cut meat, bread and other edible and inedible materials. Power reciprocating knives have been particularly useful to the meat-cutting industry where production is highly dependent upon the speed with which meat can be cut. Solenoid operated and gear driven knives are known to the art, but the complexity of their designs makes them difficult to assemble and repair. Solenoid knives may also be susceptible to electric shortcircuiting when used in a moist environment. A reciprocating knife which is efficient, accurate and readily assembled and repaired is disclosed in U.S. Pat. No. 3,283,407 issued to Bacon, one of the inventors of the improvements hereinafter described. The Bacon knife uses a rotatably mounted, elongated drive shaft with an inclined cam plate affixed thereon to drive a track-guided knife blade by positioning the edge of the inclined cam within a blade opening and rotating the cam such that the blade reciprocates in accordance with the varying position of the cam edge. This knife has numerous advantages for use and maintenance. It is reasonably inexpensive to manufacture and assemble; it may be used while completely immersed in water; and it may easily be cleaned after use. Should the cam or blade become excessively worn, each can be easily replaced without excessive delay.

The Bacon knife would typically be constructed with some play between the cam edge and the rim of the blade opening. Moreover, as the cam and the rim become worn with use, the amount of play between them increases. While such wear may not appreciably affect the operability of the knife, such play does cause noticeable vibrations as the blade reaches the forward and rearward extents of its stroke. Moreover, there will be a corresponding noise produced as the rim of the blade opening hits against the cam surface. Eventually, blade replacement may become necessary. In addition, wear of the cutting edge during use of the knife can make blade sharpening or at least temporary blade replacement expedient to efficient operation. Operability of the Bacon knife may be further affected by wear of the drive shaft such that the shaft itself in effect reciprocates in its mount. Such play of the shaft within its mount, especially when taken together with the play of the cam within the blade opening, can appreciably reduce stroke length and hence the cutting efficiency of the knife. Such wear may require early shaft replacement. While convenient replacement of worn parts is an advantage of the Bacon knife, such replacement should, of course, be minimized to reduce the cost of replacement parts and to avoid the loss of productivity associated with knife maintenance.

SUMMARY OF THE INVENTION

The improved reciprocating knife of this invention improves upon the knife disclosed in U.S. Pat. No. 3,283,407 by reducing the vibrational effects and noise associated with blade reciprocation and by prolonging the useful life of the major knife components. The rim of the blade opening is biased against the cam plate over at least a part of the reciprocating cycle. This modulates the play between the cam plate and the rim of the blade opening during operation and substantially reduces the effect of the vibrations and noise otherwise encountered during operation. Blade wear is reduced by reinforcing the rim of a blade opening. The reinforcement is preferably reversibly affixed to the blade such that it may be replaced without requiring replacement of the blade. A shaft collar and a collar stop are disclosed which allow the fit of the shaft within its mount to be adjusted. Thus, should the shaft become worn at its end, the collar may be repositioned along the shaft until the desired fit is attained again. A reversibly detachable cutting blade section is disclosed which allows replacement of the cutting edge of the knife without replacing the portion of the blade which is engaged by the rotating cam plate.

BRIEF DESCRIPTION OF THE DRAWINGS

FIG. 1 is a side elevational view of an improved reciprocating knife constructed in accordance with this invention and showing the cutting blade section removed.

FIG. 2 is a longitudinal section taken substantially along line 2—2 of FIG. 1 but showing the complete drive shaft and cam of the blade drive.

FIG. 6 is an exploded perspective view of an alternate shaft mount design with separately formed components.

DETAILED DESCRIPTION OF THE PREFERRED EMBODIMENT

Figures 3, 4, 5:
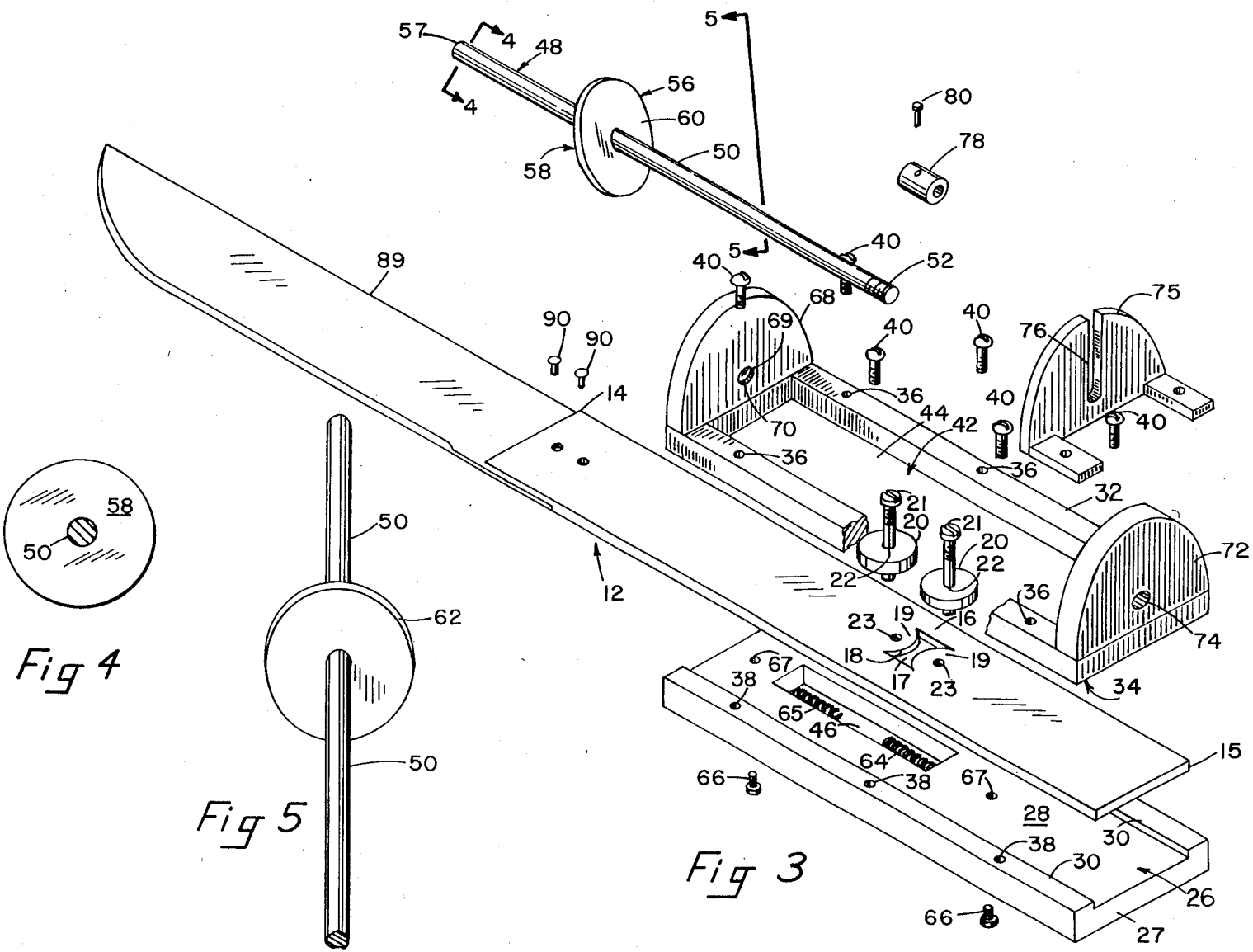
FIG. 3 is an exploded perspective view of the knife shown in FIG. 1.
FIG. 4 is a front planar view of the preferred cam plate taken along section line 4—4 of FIG. 3 which is aligned normal to its axis of rotation.
FIG. 5 is a planar view of the rearward surface of the preferred cam plate taken along section line 5—5 of FIG. 3 which is aligned parallel to the rearward surface.

An improved reciprocating knife constructed in accordance with this invention is shown generally at 10 in FIG. 1 and FIG. 2. As best seen in FIGS. 2 and 3, the knife 10 has an elongated blade 12 having a front 14, a rear 15, and a rearward blade section 16 which contains a blade opening 17. The blade opening 17 has a rim 18 of selected shape. The rim 18 is preferably reinforced to reduce its rate of wear. The blade opening 17 of the preferred embodiment is generally H-shaped with a pair of ears 19 which project longitudinally into the blade opening and, as shown in FIG. 3, are rounded into the shape of circular arcs. Circular drive disks 20 may then be mounted to the blade 12 such that the ear portions of the rim 18 include a portion of the disk circumference. The preferred means for mounting the drive disks 20 to the blade 12 includes screws 21 which are reversibly threaded through holes 22 and 23 respectively situated in the drive disks and the blade. Consequently, the drive disks 20 may be replaced without requiring replacement of the entire blade 12.

A blade guide shown generally at 24 in FIG. 2 provides a track 26 within which the blade 12 can reciprocate between a forward position in which the front 14 extends forwardly a selected distance from the blade guide and a rearward position in which the front is withdrawn rearwardly from its forward position. The preferred blade guide 24 has a lower guide member 27 with a substantially flat base portion 28 and a pair of parallel side flanges 30 extending upward therefrom to define the sides of the track 26. An upper guide member 32 has a substantially flat bottom 34 designed to overlie the base portion 28 of the lower guide member 27 at a distance therefrom approximately equal to the thickness of blade 12. As best shown in FIG. 3, the side flanges 30 are separated by a distance only slightly larger than the width of the blade 12 and extend upward from the base portion 28 by a distance only slightly larger than the thickness of the blade; and the bottom 34 is affixed to the top of the side flanges to create the track 26 around the rearward blade section 18. Preferably, holes 36 are provided in the upper blade guide member 32 and are adapted to be placed in alignment with holes 38 and the side flanges 30 such that screws 40 can be inserted through the aligned holes 36 and 38 to secure the upper blade guide member to the lower blade guide member 27. Thus, the track 26 bounded by the base portion 28, the bottom 34, and the opposed flanges 30 and is consequentially sized to closely guide the reciprocating movement of the blade 12.

The blade guide 24 has a guide aperture 42 which is alignable with the blade opening 17. Preferably, the upper blade guide member 32 has an upper slot 44 and the lower blade guide member 27 has a lower slot 46 which is aligned with the upper slot to form the guide aperture 42. Thus, when the blade 12 is properly situated within the track 26, the blade opening 17 lies between the upper slot 44 and the lower slot 46. As shown best in FIG. 3, the upper slot 44 is sized to allow the drive disks 20 to move therein as the blade 12 reciprocates.

The blade drive shown generally at 48 includes an elongated shaft 50 positioned adjacent to the blade guide 24. The blade drive 48 is connectable with a drive means for imparting rotational movement to the shaft about its central axis. In the embodiment shown in FIGS. 1 through 3, the blade drive 48 includes a shaft 50 having a threaded rearward end 52 which may be engaged by the motor driven cable 54. The cam plate 56 surrounds the shaft 50 between its forward end 57 and its rearward end 52, and is shaped such that the forward plate surface 58 and the rearward plate surface 60 extend into the guide aperture 42 and the blade opening 17. The cam plate 56 is inclined at an angle with respect to the central axis of the shaft and the edge 62 of the cam plate is shaped to extend into the blade opening 17 as the shaft 50 rotates about its central axis such that at least one of said plate surfaces 58 and 60 engages the rim 18 of the blade opening 17 to reciprocate the blade 12 within the track 26.

The blade opening rim 18 in the improved reciprocating knife 10 is biased against the cam plate over at least a part of the reciprocating cycle in a manner that aids the reciprocating movement of the blade 12 for a portion of the reciprocating cycle and resists the reciprocating movement of the blade for another portion of the reciprocating cycle. This bias modulates any play between the cam plate 56 and the rim 18 as the blade 12 reciprocates. Thus the effects of the vibration and noise associated with reciprocation is substantially reduced. The preferred biasing means includes at least one spring which is connected at one end to the blade 12 and at the other end to the lower guide member 27. To better reduce the noise and vibrational effects associated with excessive play between the cam plate 56 and the blade opening rim 18, blade movement is further modulated in the preferred embodiment by providing two opposed extension springs 64 and 65. The first spring 64 biases the blade toward its forward position and the second spring 65 equally biases the blade toward its rearward position. Consequently, at rest the blade is urged to a position generally midway between its forward and its rearward positions. The ends of the first spring 64 are preferably fastened respectively to the lower guide member 27 forward of the lower slot 46 and to the blade 12 forward of the blade opening 17; and the ends of the second spring 65 are preferably fastened respectively to the lower guide member rearward of the lower slot and to the blade rearward of the blade opening. Preferably, the lower slot 46 is sized to accommodate the reciprocation limits of the ends of the springs 64 and 65 which are fastened to the blade. The spring ends fastened to the blade 12 may be secured to the screws 21. Preferably, screws 66, which threadably engage holes 67, are provided for securing the springs 64 and 65 to the lower guide member 27. While extension springs are shown as the preferred biasing means, it is understood that other biasing means such as compression springs or elastic bands will be evident to those skilled in the art and are included within the scope of this invention.

The blade drive 48 of the improved reciprocating knife 10 must be mounted such that the shaft 50 is free to rotate in its position adjacent to the blade guide 24, and that rotation of the shaft 50 results in the desired blade reciprocation. The mounting means of the preferred embodiment, as shown in FIG. 2 and FIG. 3, includes a first bearing 68 which is secured to the blade guide 24, and has a first bearing aperture 69 which receives a portion of the shaft 50 forward of the cam plate 56. A cap 70 is positioned to limit the extent to which the shaft 50 may be inserted through the first bearing aperture 69. A second bearing 72 is preferably secured to the blade guide 24 and has a second bearing aperture 74 which receives a portion of the shaft rearward of shaft rearward of the cam plate 56. A collar stop 75 is secured to the blade guide 24 and has a channel 76 through which the shaft 50 passes without obstruction; and an adjustable collar 78 is reversibly secured by means of set screw 80 to the shaft 50 between the cap 70 and the collar stop 75. The collar 78 is sized such that it is unable to pass through the channel 76. Thus, the collar 78 may be advanced to the collar stop 75 to adjust the fit of the shaft 50 between the collar stop and the cap 70. Moreover, should the forward end 57 of the shaft 50 become worn, the collar 78 may be repositioned along the shaft until the desired fit is again attained. Any of the bearings 68 and 72, and the cap 70 and the collar stop 75 may be integrally formed with the upper guide member 32 or, alternatively, as shown for the collar stop in FIG. 3, and for the bearings 68 and 72, and the cap 70 in FIG. 6, they may be formed separately from the blade guide 24 and secured thereto. When separately formed as shown in FIG. 6, the first bearing 68 may be secured to the upper guide member 32 by threading screws 81 through the holes 82 in the first bearing and into holes 83 in the upper guide member; the second bearing 72 may be secured by threading screws 84 through the holes 85 and into holes 86; and the cap 70 may be secured by threading screws 87 through holes 88 in the cap and into holes (not shown) in the first bearing 68. The collar stop 75 in FIG. 3 is secured to the upper guide member 32 using the same screws 40 used to secure the upper guide member to the lower guide member 27. In any case, the bearing apertures 69 and 74 are preferably aligned such that the central axis of the shaft is aligned with the longitudinal blade axis; all points on the edge 62 of the cam plate 56 are substantially equidistant from the central axis of the shaft; and the cam plate is inclined at an angle of approximately 65° with respect to the central axis of the shaft. However, it will be understood that various drive shafts can be used in this improved knife with each of such drive shafts having a cam plate inclined at a different angle such that the stroke of reciprocation of the blade 12 can be selectively varied as desired.

It is understood that the front 14 of the blade 12 may be elongated and provided with a cutting edge. However, the improved reciprocating knife 10 preferably has a cutting blade section 89 which may be selectively affixed to and removed from the front of the blade 12. Such reversible assembly may be accomplished using fitted screws 90 as shown in FIG. 3 or other conventional attachment means.

A casing shown generally at 91 is preferably provided for protecting the operator of the improved reciprocating knife and for providing a grasping surface for a knife operator to hold. As seen in FIG. 1, the casing 91 substantially encloses the blade guide 24, the blade drive 48, the bearings 68 and 72, the cap 70, the collar stop 75 and collar 78. As best shown in FIG. 2, the preferred casing 91 has a forward portion 92 with the forward casing hole 93 through which the blade 12 extends, a body 94 with a substantially cylindrical threaded rearward end 95 which is adapted to be centered around the central axis of the shaft 50, and a rearward portion 96 which threadably engages the rearward end 93 and has a rearward casing hole 97 adapted to allow connection of the shaft 50 to the drive means. The forward portion 92 is fixedly engaged to the body 94 and is enlarged somewhat beyond the outer limits of the body in order to act as a safety stop for the operator's hand. The rearward casing hole 97 is centered with respect to the rearward portion 96 to allow rotation of the rearward portion with the shaft extended therethrough.

In assembling the knife components of the preferred embodiment wherein the bearings 68 and 72 and the cap 70 are integrally formed with the upper guide member 32 as shown in FIG. 3, the blade guide members 27 and 32 are suitably fastened together by the screws 40. The collar stop 75 is also secured to the upper guide member 32 with the screws 40. The rearward blade section 16 is placed within the track 26 created by the assembled guide members 27 and 32 and the reinforcing drive disks 20 are fastened to the blade 12 using screws 21. The biasing springs 64 and 65 are secured to the lower guide member 27 using screws 66 and to the blade 12 using the adjacent ends of the screws 21. The collar 78 is suitably placed on the shaft 50 rearward of the cam plate 56 with the set screw 80 loosened. The rearward end 52 of the shaft 50 may then be inserted through the second bearing aperture 74 and the forward end 57 inserted through the first bearing aperture 69 and advanced to the cap 70. The positioning of the shaft 50 within the bearing apertures 69 and 74 is done while inserting a portion of the cam plate 56 into the guide aperture 42 between the ears 19 of the blade opening 17; and while inserting the shaft 50 within the collar stop channel 76. The collar 78 may then be advanced along the shaft to the collar stop 75 and the set screw 80 tightened. The blade front 14 is then inserted through the forward casing hole 93 with the body 94 of the casing 91 surrounding the blade guide 24, the cam plate 56, the bearings 68 and 72, and the cap 70. The rearward casing hole 97 is placed around the shaft 50 and the rearward casing portion 96 is then threaded to the rearward end 95 of the casing body 94. The cable 54 may then be threaded onto the rearward shaft end 52. The cutting blade section 89 is secured to the blade 12 near its front 14 using screws 90.

The cable 54 extends from a suitable conventional power supply means such as an electric motor (not shown). When the power supply means is operated it imparts a rotational movement to the cable 54. Rotation of the cable 54 will in turn impart rotational movement to the drive shaft 50 and hence to the cam plate 56. Since the cam plate is disposed at an angle within the reinforced rim 18 of the blade opening 17, the plate surfaces 58 and 60 engage the rim upon rotation of the cam plate and alternately move the blade 12 forwardly and rearwardly within the track 26. Such movement is by the springs 64 and 65 alternately aided and resisted during the reciprocating cycle as the blade position moves toward and away from a position generally midway between the forwardmost and rearwardmost position of the blade 12.

The improved reciprocating knife 10 is preferably formed of stainless steel or some other noncorrosive and rustproof material. The bearings 68 and 72 may alternatively be formed of brass or other suitable materials. To increase bearing efficiency a solid lubricant such as powdered graphite or self-lubricating plastic may be impregnated into the walls of the bearing apertures 69 and 74. As will be apparent, there are a minimum number of cooperating parts within the casing 91 and accordingly, operation of the improved reciprocating knife 10 is greatly simplified. Parts such as the drive disks 20, the springs 64 and 65, and the cutting blade section 89 may be easily replaced without substantial loss of time. Moreover, even if moisture were to work its way into the casing 91, the knife would still continue to function in a satisfactory manner. It will also be seen that the entire knife 10 can be easily cleaned by merely immersing it in water.

The materials, parts, and methods of assembly disclosed above are those preferred by the inventor. It is understood that the present invention is not limited to the particular materials, construction, arrangement of parts, and methods illustrated and disclosed above. Instead, it embraces all such modified forms thereof as come within the scope of the following claims.

What is claimed is:

1. An improved reciprocating knife comprising:

(a) an elongated blade having a front, a rear, and a rearward blade section having a blade opening with a rim of selected shape;

(b) a blade guide defining a track around said rearward blade section for guiding the reciprocating movement of said blade over a reciprocating cycle between a forward position in which the front extends forwardly a selected distance from the blade guide and a rearward position in which the front is withdrawn rearwardly from its forward position, said blade guide having a guide aperture alignable with said blade opening;

(c) a blade drive including an elongated shaft positioned adjacent to said blade guide and connectable with a drive means for imparting rotational movement to said shaft about its central axis, and said blade drive also including a cam plate surrounding said shaft and secured thereto, which cam plate is angled with respect to the central axis of the shaft, and has two plate surfaces which extend into said guide aperture and blade opening with one of said plate surfaces facing generally forwardly and the other plate surface facing generally rearwardly;

(d) mounting means for mounting said blade drive such that the shaft is free to rotate in its position adjacent to the blade guide, and that rotation of the shaft causes at least one of said plate surfaces to engage the rim of the blade opening to reciprocate the blade within the track; and (e) biasing means for biasing the rim of the blade opening against said cam plate over at least a part of the reciprocating cycle such that any play between the cam plate and the rim is modulated, and such that the biasing means aids the reciprocating movement of the blade for a portion of the reciprocating cycle and resists the reciprocating movement of the blade for another portion of the reciprocating cycle, wherein the biasing means includes two opposed elastic members.

2. The improved reciprocating knife of claim 1 wherein the elastic members are balanced to bias the blade to a position generally midway between its forward position and its rearward position.

3. The improved reciprocating knife of claim 1 wherein the two opposed elastic members are springs, the first spring biasing the blade toward its forward position and the second spring biasing the blade toward its rearward position.

4. The improved reciprocating knife of claim 1 further including a cutting blade section which has a cutting edge and may be selectively affixed to and removed from the front of the blade.

5. The improved reciprocating knife of claim 4 wherein the cutting blade section is affixed to the blade by screws.

6. The improved reciprocating knife of claim 1 further comprising reinforcing means for reinforcing the rim of the blade opening.

7. The improved reciprocating knife of claim 6 wherein the blade opening is generally H-shaped with a pair of rounded ears projecting longitudinally toward each other; and wherein the reinforcing means comprises a pair of drive disks mounted to the blade such that the disk circumferences reinforce the ear portions of the rim.

8. The improved reciprocating knife of claim 1 wherein said mounting means includes a first bearing which is secured to the blade guide and has a first bearing aperture which receives a portion of the shaft forward of the cam plate; a cap for limiting the extent to which the shaft may be inserted through the first bearing aperture; a second bearing secured to the blade guide and has a second bearing aperture which receives a portion of the shaft rearward of the cam plate; a collar stop which is secured to the blade guide and has a channel through which the shaft passes without obstruction; and an adjusting collar which is unable to pass through the channel and is reversibly secured to the shaft between the cap and the collar stop such that the fit of the shaft between the cap and the collar stop may be adjusted.

9. The improved reciprocating knife of claim 1 further comprising a casing which substantially encloses said blade guide, said mounting means, and said blade drive so as to provide a grasping surface for a knife operator to hold, said casing having a forward casing hole through which the blade extends and a rearward casing hole adapted to allow connection of the shaft to the drive means.

10. An improved reciprocating knife comprising:

(a) an elongated blade having a front, a rear, and a rearward blade section having a blade opening with a rim of selected shape;

(b) a blade guide including an upper guide member having an upper slot and a lower guide member secured to said upper guide member with two upstanding side flanges therebetween to define a track around said rearward blade section for guiding the reciprocating movement of said blade over a reciprocating cycle between a forward position in which the front tip extends forwardly a selected distance from the blade guide and a rearward position in which the front tip is withdrawn rearwardly from its forward position, said lower guide member having a lower slot which is aligned with the upper slot to form a guide aperture which is alignable with the blade opening such that the blade opening is between the upper slot and the lower slot;

(c) a blade drive including an elongated cylindrical shaft positioned adjacent to said upper guide member and connectable with a drive means for imparting rotational movement to said shaft about its central axis and said blade drive also including a cam plate surrounding said shaft and secured thereto, which cam plate is angled with respect to the central axis of the shaft and has two plate surfaces which extend into said guide aperture and blade opening with one of said plate surfaces facing generally forwardly and the other plate surface facing generally rearwardly;

(d) mounting means for mounting said blade drive such that the shaft is free to rotate in its position adjacent to the upper guide member, and that rotation of the blade drive causes at least one of said plate surfaces to engage the rim of the blade opening to reciprocate the blade within the track; and (e) two opposed springs balanced to bias the blade to a position generally midway between its forward position and its rearward position, the first spring biasing the blade toward its forward position and the second spring biasing the blade toward its rearward position such that the play between the cam plate and the rim is modulated and such that the springs aid the reciprocating movement of the blade for a portion of the reciprocating cycle and resist the reciprocating movement for another portion of the reciprocating cycle.

11. The improved reciprocating knife of claim 10 wherein the blade opening is generally H-shaped with a pair of rounded ears projecting longitudinally toward each other; wherein the rim of the blade opening is reinforced by a pair of drive disks reversibly mounted to the surface of the blade facing the blade drive such that the disk circumferences reinforce the ear portions of the rim; and wherein the upper slot is sized to allow the drive disks to move therein as the blade reciprocates.

12. The improved reciprocating knife of claim 10 wherein the springs are extension springs and the ends of the first spring are respectively fastened to the lower guide member forward of the lower slot and to the blade forward of the blade opening, and the ends of the second spring are respectively fastened to the lower guide member rearward of the lower slot and to the blade rearward of the blade opening.

13. The improved reciprocating knife of claim 12 wherein the rim of the blade opening is longitudinally reinforced by forward and rearward replaceable drive disks, each disk reversibly secured by a screw to the surface of the blade facing the blade drive; wherein the upper slot is sized to allow the drive disks to move therein as the blade reciprocates; wherein the end of the first spring fastened to the blade is attached to the screw securing the forward drive disk, and the end of the second spring fastened to the blade is attached to the screw securing the rearward drive disk; and wherein the lower slot is sized to accommodate the reciprocation limits of the spring ends fastened to the blade.

14. The improved reciprocating knife of claim 10 wherein said mounting means includes a first bearing which is secured to the blade guide and has a first bearing aperture which receives a portion of the shaft forward of the cam plate; a cap for limiting the extent to which the shaft may be inserted through the first bearing aperture; a second bearing which is secured to the blade guide and has a second bearing aperture which receives a portion of the shaft rearward of the cam plate; a collar stop which is secured to the blade guide and has a channel through which the shaft passes without obstruction; and an adjusting collar which is unable to pass through the channel and is reversibly secured to the shaft between the cap and the collar stop such that the fit of the shaft between the cap and the collar stop may be adjusted.

15. The improved reciprocating knife of claim 10 further including a cutting blade section which has a cutting edge and may be selectively affixed to and removed from the front of the blade.

16. The improved reciprocating knife of claim 15 wherein the cutting blade section is affixed to the blade by screws.

17. The improved reciprocating knife of claim 10 further comprising a casing which substantially encloses said blade guide, said mounting means, and said blade drive so as to provide a grasping surface for a knife operator to hold, said casing having a forward casing hole through which the blade extends and a rearward casing hole adapted to allow connection of the shaft to the drive means.

* * * * *